US011499771B2

(12) United States Patent
Park

(10) Patent No.: US 11,499,771 B2
(45) Date of Patent: Nov. 15, 2022

(54) REFRIGERATOR

(71) Applicant: LG Electronics Inc., Seoul (KR)

(72) Inventor: Cheolsoon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/237,803

(22) Filed: Apr. 22, 2021

(65) Prior Publication Data

US 2021/0372689 A1 Dec. 2, 2021

(30) Foreign Application Priority Data

Jun. 1, 2020 (KR) ..... 10-2020-0065847

(51) Int. Cl.
*F25D 23/04* (2006.01)
*F25D 23/02* (2006.01)

(52) U.S. Cl.
CPC ..... *F25D 23/04* (2013.01); *F25D 23/025* (2013.01); *F25D 2323/023* (2013.01)

(58) Field of Classification Search
CPC ..... F25D 23/025; F25D 2323/023; F25D 23/028; F25D 23/04; F25D 23/02; E05B 65/0042; E05B 1/0038; E05B 65/06; E05C 7/02; E05C 3/06; E05C 1/12
See application file for complete search history.

(56) References Cited

U.S. PATENT DOCUMENTS 3,086,830 A * 4/1963 John ..... F25D 23/04 62/448
9,410,732 B2 8/2016 Choi et al.
2015/0176886 A1* 6/2015 Lee ..... F25D 23/00 312/404

(Continued)

FOREIGN PATENT DOCUMENTS

CN 104729181 6/2015
CN 108278806 7/2018

(Continued)

OTHER PUBLICATIONS

English translation for KR20170119923 (Year: 2017).*

(Continued)

*Primary Examiner* — Hiwot E Tefera
(74) *Attorney, Agent, or Firm* — Fish & Richardson P.C.

(57) ABSTRACT

A refrigerator includes a cabinet that defines a storage space, a main door having an opening, and a sub-door configured to, based on rotating in the rotation directions of the main door relative to the main door, open and close the opening of the main door. The sub-door further includes an operation unit disposed at a lower side of the sub-door and configured to be operated by a user, a latch unit disposed vertically above the operation unit and configured to catch a portion of the main door, and a connection unit that connects between the operation unit and the latch unit. The connection unit includes a connection member that extends from an upper end in contact with the latch unit to a lower end in contact (Continued)

with the operation unit, and a connection member case defining a connection member accommodating portion that receives the connection member.

17 Claims, 16 Drawing Sheets

(56) References Cited

U.S. PATENT DOCUMENTS

| | | | | |
|---|---|---|---|---|
| 2015/0241116 | A1* | 8/2015 | Choi | F25D 23/00 312/405 |
| 2017/0038126 | A1* | 2/2017 | Lee | F25D 23/025 |
| 2018/0202707 | A1* | 7/2018 | Park | F25D 23/04 |
| 2019/0063123 | A1* | 2/2019 | Ham | D06F 39/14 |
| 2019/0120542 | A1* | 4/2019 | Kim | F25D 23/06 |
| 2019/0331400 | A1* | 10/2019 | Park | F25D 23/028 |
| 2019/0338999 | A1* | 11/2019 | Lee | E05B 65/06 |
| 2021/0239386 | A1* | 8/2021 | Yoon | E05C 3/30 |
| 2021/0364221 | A1* | 11/2021 | Yeom | E05C 19/16 |

FOREIGN PATENT DOCUMENTS

| | | |
|---|---|---|
| EP | 2886982 | 6/2015 |
| KR | 20130072186 | 7/2013 |
| KR | 20150074285 | 7/2015 |
| KR | 20170119923 | 10/2017 |

OTHER PUBLICATIONS

Extended European Search Report in European Appln. No. 21171178.3, dated Oct. 19, 2021, 10 pages.

Office Action in Chinese Appln. No. 202110355702.1, dated Sep. 5, 2022, 20 pages (with English translation).

* cited by examiner

REFRIGERATOR

CROSS-REFERENCE TO RELATED APPLICATIONS

This application claims the benefit of the Korean Patent Application No. 10-2020-0065847, filed on Jun. 1, 2020, the disclosures of which are hereby incorporated by reference as if fully set forth herein.

TECHNICAL FILED

The present disclosure relates to a refrigerator.

BACKGROUND

Refrigerators are home appliances that allow low-temperature storage of food in an internal storage space that is shielded by a door. For example, the refrigerator may store food in an optimal state by cooling the interior of the storage space using cold air generated through heat exchange with a refrigerant circulating through a refrigeration cycle.

In some cases, a refrigerator may have a large size and perform multiple functions in accordance with changes in dietary life and the trend of high-end products. The refrigerators with various structures and convenience devices may improve users' convenience and energy efficiency.

In some cases, a refrigerator may have a separate storage space in a door of the refrigerator, and a home bar door may open and close the separate storage space such that food can be stored in the storage space.

In some cases, a refrigerator may have a storage space in a first door, and a sub-door that is rotatable relative to the first door to open and close the storage space. The storage space may have a size defining the entire upper portion of the first door, so that ends portion of the sub-door are positioned at the same positions as the left and right side ends and the upper end of the first door.

In some cases, the first door and the sub-door may include a locking unit that includes a latch hook and a latch cam so that the sub-door can be fixed in a closed state. The constraint of the locking unit may be released by operation of an operation button provided on the sub-door to allow the door to be opened.

The operation button for opening the sub-door may be exposed to the front of the sub-door, and thus the appearance of the front of the refrigerator door, which occupies most of the exterior of the refrigerator, may be deteriorated.

In some cases, the operation button may be located at a position corresponding to the position of the locking unit for constraining the sub-door. The installable position of the operation button may be very limited, which may limit the operation structure.

In some cases, the operation button may be pressed in a direction opposite to an opening direction of the door, which may cause inconvenience in use or operation.

SUMMARY

The present disclosure describes a refrigerator including an operation member for opening operation of a sub-door of the refrigerator.

The present disclosure also describes a refrigerator including a latch member for releasing the constraint of a door, and an operation member that is operated for the operation of the latch member and that is connected by a connection member. The latch member can be disposed at a position where the door is easily fixed, and the operation member can be disposed at another position that is easy to operate.

The present disclosure further describes a refrigerator including a protrusion disposed in a connection member case in which the connection member is accommodated, and the protrusion is configured to prevent the connection member from moving in other directions when the connection member is moved.

According to one aspect of the subject matter described in this application, a refrigerator includes a cabinet that defines a storage space, a main door that is configured to, based on rotating in rotation directions relative to the cabinet, open and close the storage space, and that defines an opening, and a sub-door that is configured to, based on rotating in the rotation directions of the main door relative to the main door, open and close the opening of the main door. The sub-door includes an outer case that defines a front surface of the sub-door, and a door liner that defines a rear surface of the sub-door. The sub-door further includes an operation unit disposed at a lower side of the sub-door and configured to be operated by a user, a latch unit that is disposed vertically above the operation unit, that is spaced apart from the operation unit, and that protrudes from the rear surface of the sub-door toward the main door, the latch unit being configured to selectively couple the sub-door to the main door, and a connection unit that connects between the operation unit and the latch unit and is configured to operate the latch unit based on the user operating the operation unit. The main door includes a latch accommodating portion that faces the latch unit and is configured to be caught by the latch unit. The connection unit includes a connection member that extends from an upper end in contact with the latch unit to a lower end in contact with the operation unit, where the connection member is configured to move in a first direction to thereby operate the latch unit based on the user operating the operation unit. The connection unit further includes a connection member case having an upper side connected to the latch unit and a lower side connected to the operation unit, where the connection member case defines a connection member accommodating portion that receives the connection member, and includes a protrusion that protrudes from an inner surface of the connection member case toward the connection member. The protrusion is configured to, based on the connection member moving in the first direction, restrict movement of the connection member in a second direction crossing the first direction.

Implementations according to this aspect can include one or more of the following features. For example, the protrusion can be configured to contact the connection member. In some examples, the sub-door can further include a cap decor that is coupled to the outer case and the door liner, where the cap decor, the outer case, and the door liner define an inner space of the sub-door, and the inner space accommodates an insulating material. The connection member case can be mounted in the inner space of the sub-door and block the insulating material from the connection member accommodating portion.

In some implementations, the connection member case can include a first connection member case disposed at a front side of the connection member case, and a second connection member case disposed at a rear side of the connection member case and mounted to the door liner. The first and second connection member cases can be coupled to each other and define the connection member accommodating portion. The protrusion can include a first protrusion that protrudes from a rear surface of the first connection member case toward the second connection member case, and a second protrusion that protrudes from a front surface of the second connection member case toward the first connection member case.

In some implementations, the first connection member case can include a rib that is disposed at a front surface of the first connection member case and supports the cap decor.

In some implementations, the connection unit can further include an elastic portion that is coupled to the connection member and protrudes outward relative to the connection member, where the elastic portion is configured to restrict movement of the connection member in the second direction. An outer diameter of the elastic portion can be less than an inner diameter of the connection member accommodating portion. In some examples, the elastic portion can have a cylindrical shape and surrounds the connection member.

In some implementations, the latch unit can further include a latch member that is disposed at the door liner and protrudes toward the main door and that passes through a rear surface of the door liner, and a latch case that accommodates the latch member and blocks the insulating material from the latch accommodating portion. In some examples, the latch case can be a part of the first connection member case. In some examples, the latch accommodating portion can be recessed from a front surface of the main door. The main door can further include a holding portion that protrudes from the latch accommodating portion and is configured to catch an end of the latch member.

In some examples, the latch member can include a constraining portion that protrudes from an end of the latch member and has a hook shape and is configured to be caught by the holding portion. In some examples, the constraining portion protrudes downward from the end of the latch member and is configured to be released from the holding portion based on the latch member rotating upward relative to the holding portion.

In some implementations, the operation unit can include an operation member disposed at the lower side of the sub-door and configured to move in a vertical direction. In some examples, the sub-door can be configured to rotate about a rotation axis extending parallel to the vertical direction. In some examples, the operation member can include a lever configured to rotate about an axis extending in a horizontal direction. In some examples, the connection member can include a bent portion having a lower end in contact with the operation member.

In some implementations, the refrigerator can include an elastic member coupled to the lower end of the connection member and configured to apply force to the operation member. For example, the elastic member can include a spring.

In some implementations, the refrigerator can include a support member disposed between the connection member and the operation member and configured to receive a part of the connection member. In some examples, the lower end of the connection member can be configured to insert into and withdraw from the support member based on movement of the connection member.

DETAILED DESCRIPTION

Figure 1:
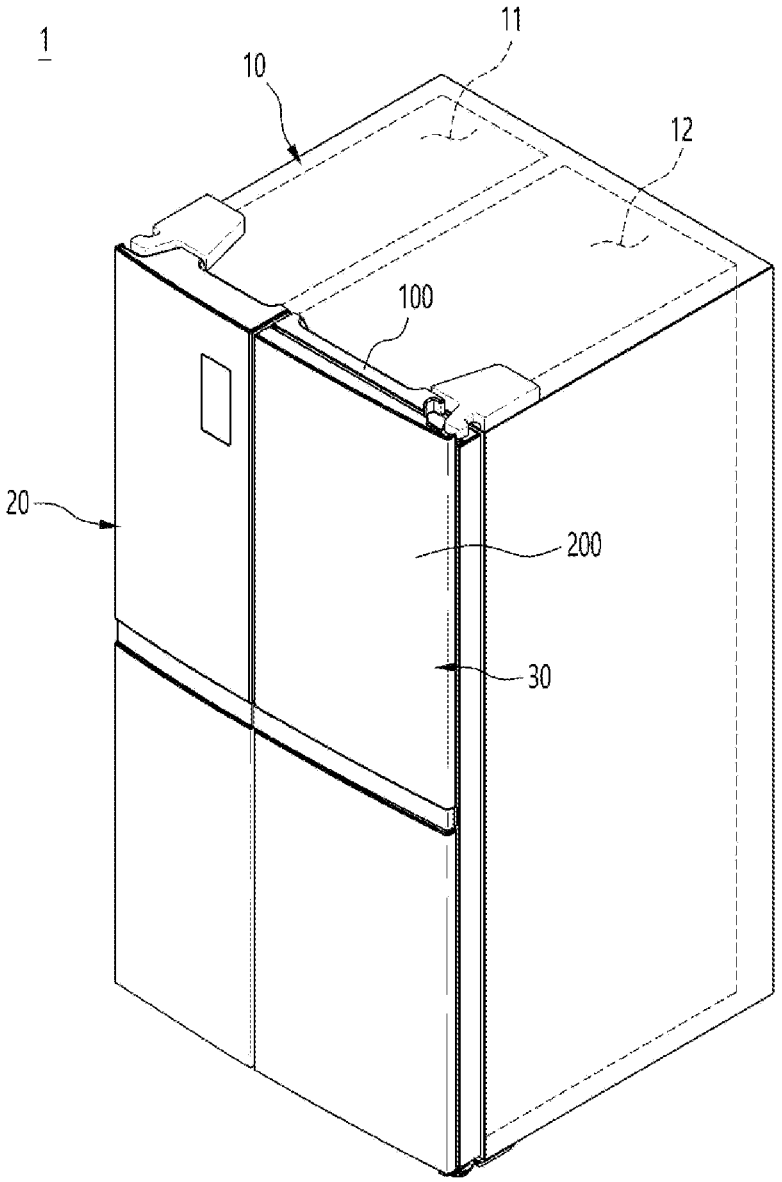
FIG. 1 is a perspective view of an example of a refrigerator.

Hereinafter, one or more examples of the present disclosure will be described in detail with reference to the exemplary drawings. In adding the reference numerals to the components of each drawing, it should be noted that the identical or equivalent component is designated by the identical numeral even when they are displayed on other drawings.

Figure 2:
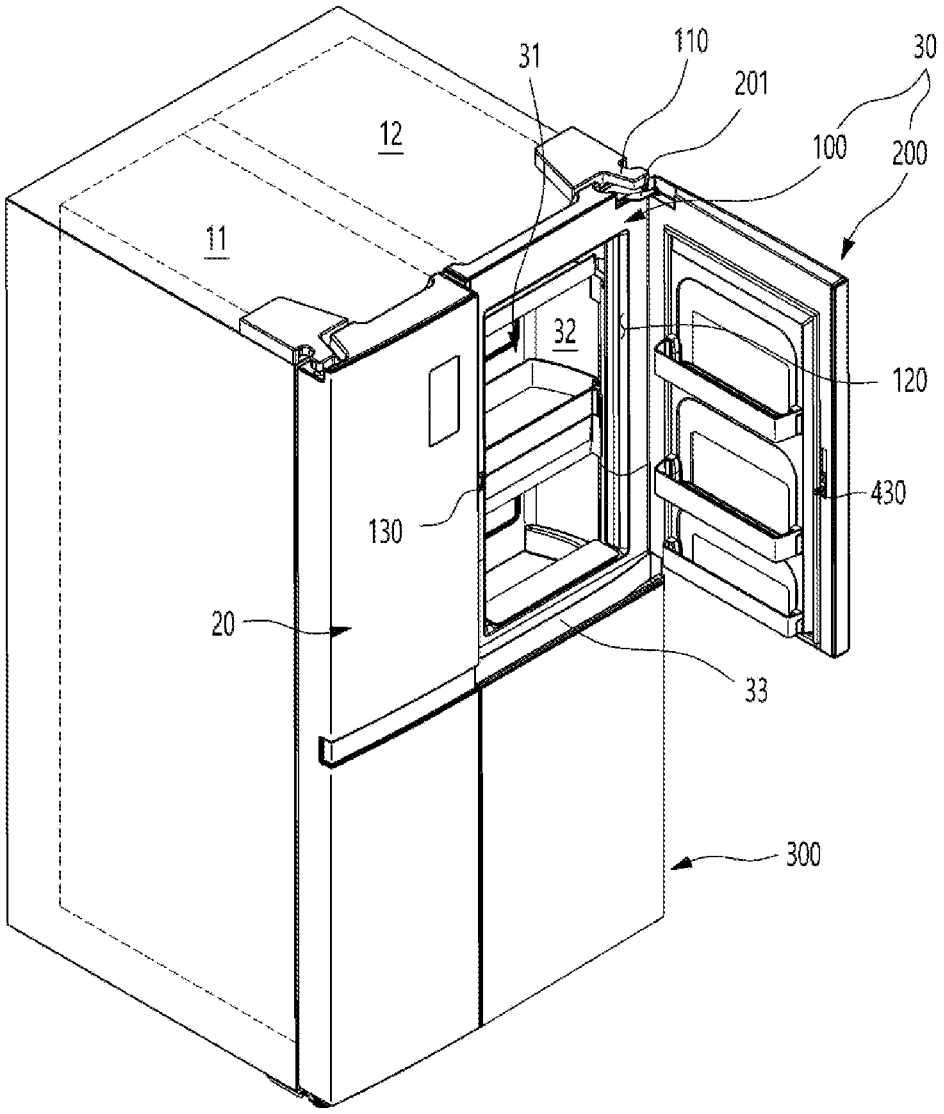
FIG. 2 is a perspective view of an example of a sub-door in an open state.
Figure 3:
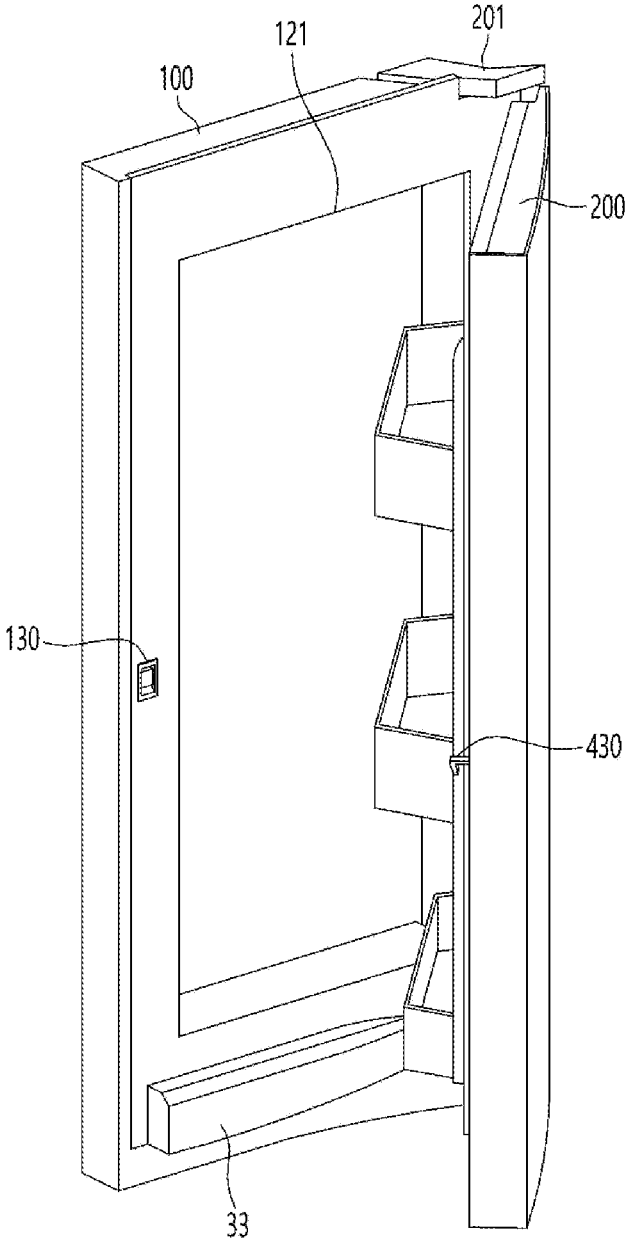
FIG. 3 is a perspective view of an example of a main door and a sub-door.

FIG. 1 is a perspective view of an example of a refrigerator, FIG. 2 is a perspective view of an example of a sub-door in an open state, and FIG. 3 is a perspective view of an example of a main door and a sub-door.

Referring to FIGS. 1 to 3, a refrigerator 1 can include a cabinet 10 that defines an external shape of the refrigerator 1 and a storage space configured to store one or more items. The refrigerator 1 can include one or more doors configured to open and close the storage space.

In some implementations, the interior of the cabinet 10 can be divided to the left and right to form a freezing chamber 11 and a refrigerating chamber 12, respectively. In addition, the door can include a freezing chamber door 20 and a refrigerating chamber door 30 that respectively shield the freezing chamber 11 and the refrigerating chamber 12.

In some implementations, the refrigerating chamber door 30 can be provided with an accommodation device 31 that defines a separate storage space separated from the interior of the refrigerating chamber 12. Accordingly, when the refrigerating chamber door 30 is closed, the interior of the refrigerating chamber 12 can be a first storage chamber, and the interior of the accommodation device 31 can be a second storage chamber 32.

In some examples, the refrigerating chamber door 30 can include a main door 100 that opens and closes the first storage chamber and a sub-door 200 that opens and closes the second storage chamber 32.

The upper end of the main door 100 is connected to the upper surface of the cabinet 10 by a door hinge 110, and the main door 100 is rotatably coupled to the cabinet 10. Further, in some examples, a separate hinge can be also provided at the lower end of the main door 100 so that the main door 100 can be rotatably mounted. Accordingly, the refrigerating chamber 12 can be opened or closed according to the rotation of the main door 100. That is, the user rotates the main door 100 to store food in the refrigerating chamber 12.

In addition, an opening 120 is formed in the main door 100. The opening 120 extends from a grip portion 33 serving as a handle to a position adjacent to the upper end of the main door 100, and can extend to a position adjacent to both left and right side ends of the main door 100. Further, the accommodation device 31 can be provided on a rear surface of the main door corresponding to the rear of the opening 120. The accommodation device 31 can have a structure that is opened forward, and can be configured to enable access to the interior of the accommodation device 31 through the opening 120.

Further, a sealer that is in contact with the edges of the front surface of the cabinet 10 when the main door 100 is closed is provided in the edges of the rear surface of the main door 100. The sealer can be formed of an elastically deformable material to be compressible, and can be configured to be in close contact with the cabinet 10 by including a magnet therein.

In addition, the opening 120 is configured to allow food constrained in the accommodation device 31 to be withdrawn in a state in which the main door 100 is closed. Accordingly, the main door 100 can open the opening 120 while the refrigerating chamber 12 is shielded, so that food can be placed in or taken out of the accommodation device 31.

In some implementations, two or more openings 120 can be arranged vertically with respect to the grip portion 33, or at least one accommodation device and at least one sub-door can be provided in each of the freezing chamber door 20 and the refrigerating chamber door 30.

In addition, the opening 120 can be further formed in the freezing chamber door 20 to be opened and closed by a separate door, and the arrangement of the door can be variously changed, for example, in such a way that only one opening 120 which is opened and closed by the sub-door 200 is provided as needed.

In some examples, the opening 120 can be formed to have a size corresponding to the front surface of the accommodation device 31, and can be formed over the position of the grip portion 33 of the main door 100 in a vertical direction and formed up to a region other than parts of the left and right side ends of the main door 100 in a horizontal direction.

The grip portion 33 is for opening and closing the refrigerating chamber door 30, that is, the main door 100, and is disposed to elongate in the horizontal direction in a lower portion of the main door 100 and is formed to be recessed such that the user can put the her/his hand therein and pull the main door. The position of the grip portion 33 is at a position that is easy for a user to grip.

The grip portion 33 can be formed to be recessed inward and downward such that the user can easily grip it. Further, the grip portion 33 can be formed in the same shape as the freezing chamber door 20 and can be formed at the same height from the left end to the right end of the refrigerator 1 when viewed from the front.

The sub-door 200 is for opening and closing the opening 120 and is rotatably mounted to the main door 100 by an upper hinge 201. Both ends of the upper hinge 201 are axially coupled to the upper surface of the main door 100 and the upper surface of the sub-door 200 such that the sub-door 200 rotates about the main door 100 as an axis.

In addition, a lower hinge is further provided at the lower end of the sub-door 200. The lower hinge is provided at the lower end of the sub-door 200 and mounted on the main door, and the sub-door 200 is rotatably supported. In some examples, the lower hinge can be provided with a cam structure or a spring structure such that the sub-door 200 can be opened and closed more smoothly.

Accordingly, the main door 100 and the sub-door 200 can independently rotate, and the refrigerating chamber 12 and the opening 120 can be selectively opened and closed by independently operating the main door 100 and the sub-door 200.

In some examples, the front surface of the sub-door 200 can be formed of the same material as the front surface of the freezing chamber door 20, and can be formed such that a drawing or pattern is continuous. In addition, the front surface of the sub-door 200 can be formed such that the front surface of the sub-door 200 is positioned on the same plane as the front surface of the freezing chamber door 20 while the sub-door 200 is closed.

In addition, the sub-door 200 is formed such that the edges other than the lower end adjacent to the grip portion 33 corresponds to the edges of the main door 100. Accordingly, the sub-door 200 can provide a sense of unity such that the connection portion, on which the sub-door 200 is formed, may not be visible when viewed from the front in a state in which the sub-door 200 is closed.

Therefore, when viewed from the front in a state in which the sub-door 200 closed, the refrigerating chamber door 30 and the freezing chamber door 20 can have the same front shape, and in the case of a first-time user, the user may not easily recognize the sub-door 200 and recognize that the entire refrigerating chamber door 30 is formed of one door.

In some examples, a door basket capable of storing food is provided on the rear surface of the sub-door 200. The door basket can be mounted to be detachable, and can be configured such that a mounting position on the rear surface of the sub-door 200 is adjustable to enable the height adjustment.

In addition, a latch unit 430 is provided on the rear surface of the sub-door 200. In addition, a latch accommodating portion 130 can be formed at one side of the main door 100 corresponding to the position of the latch unit 430. The latch accommodating portion 130 can be recessed rearward from the front surface of the main door 100.

When the sub-door 200 is closed, the latch unit 430 can be inserted into the latch accommodating portion 130, and the latch unit 430 can be constrained while being inserted into the latch accommodating portion 130 so that the sub-door 200 can be kept in a closed state.

Further, the sub-door 200 includes the latch unit 430, and a door opening/closing assembly 400 for opening and closing the sub-door 200 is provided. Hereinafter, the structure of the door opening/closing assembly 400 will be described in detail with reference to the drawings.

Figure 4:
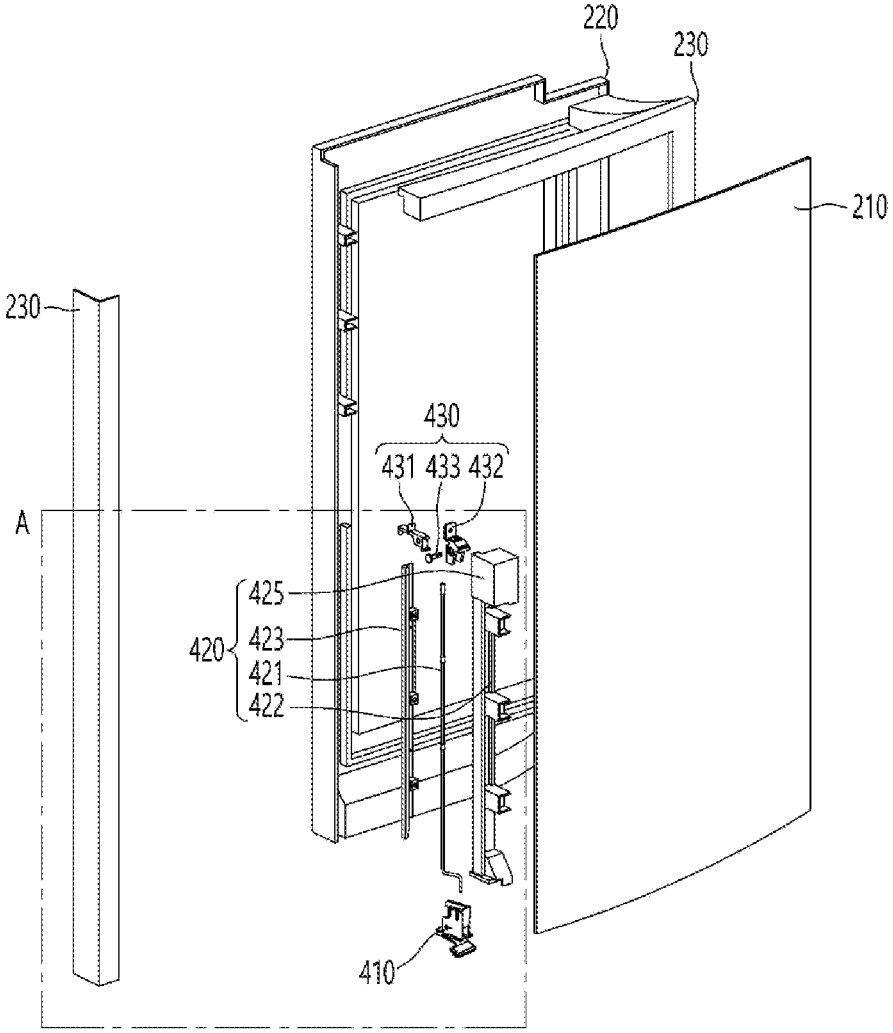
FIG. 4 is an exploded perspective view of an example of a sub-door.
Figure 5:
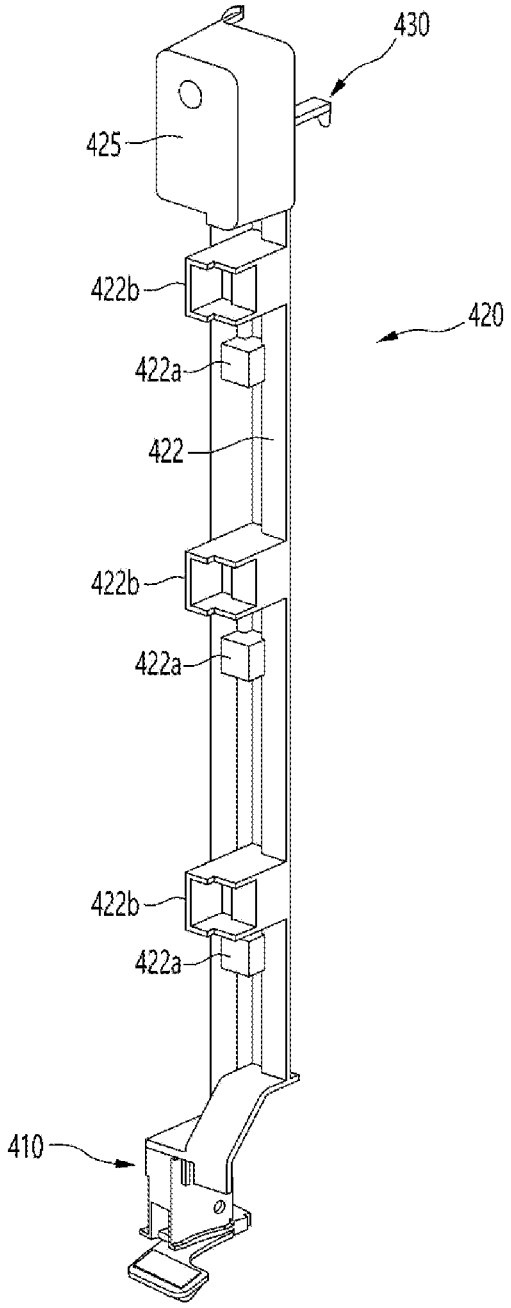
FIG. 5 is a perspective view showing an example of a door opening/closing assembly.
Figure 6:
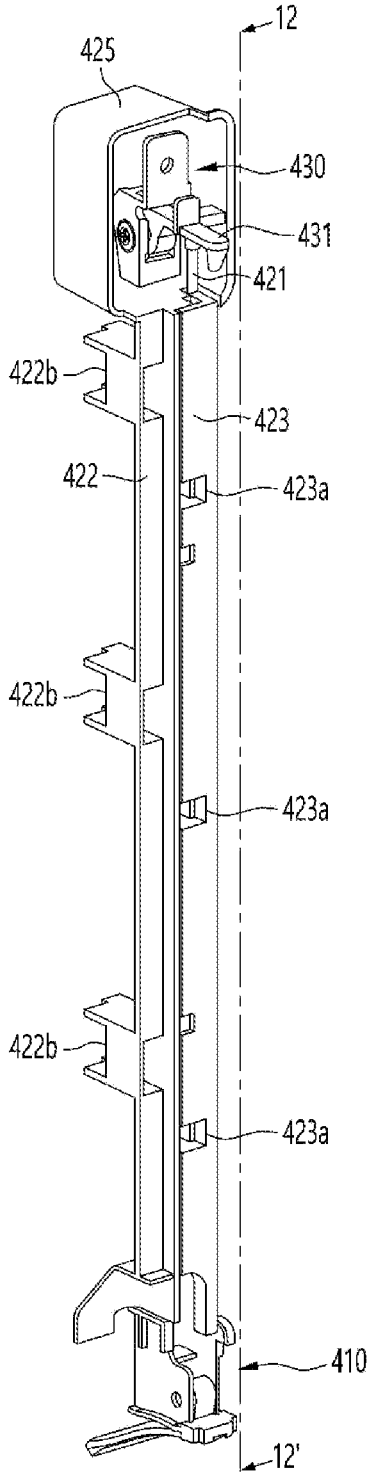
FIG. 6 is a perspective view of the door opening/closing assembly in FIG. 5 viewed in another direction.
Figure 7:
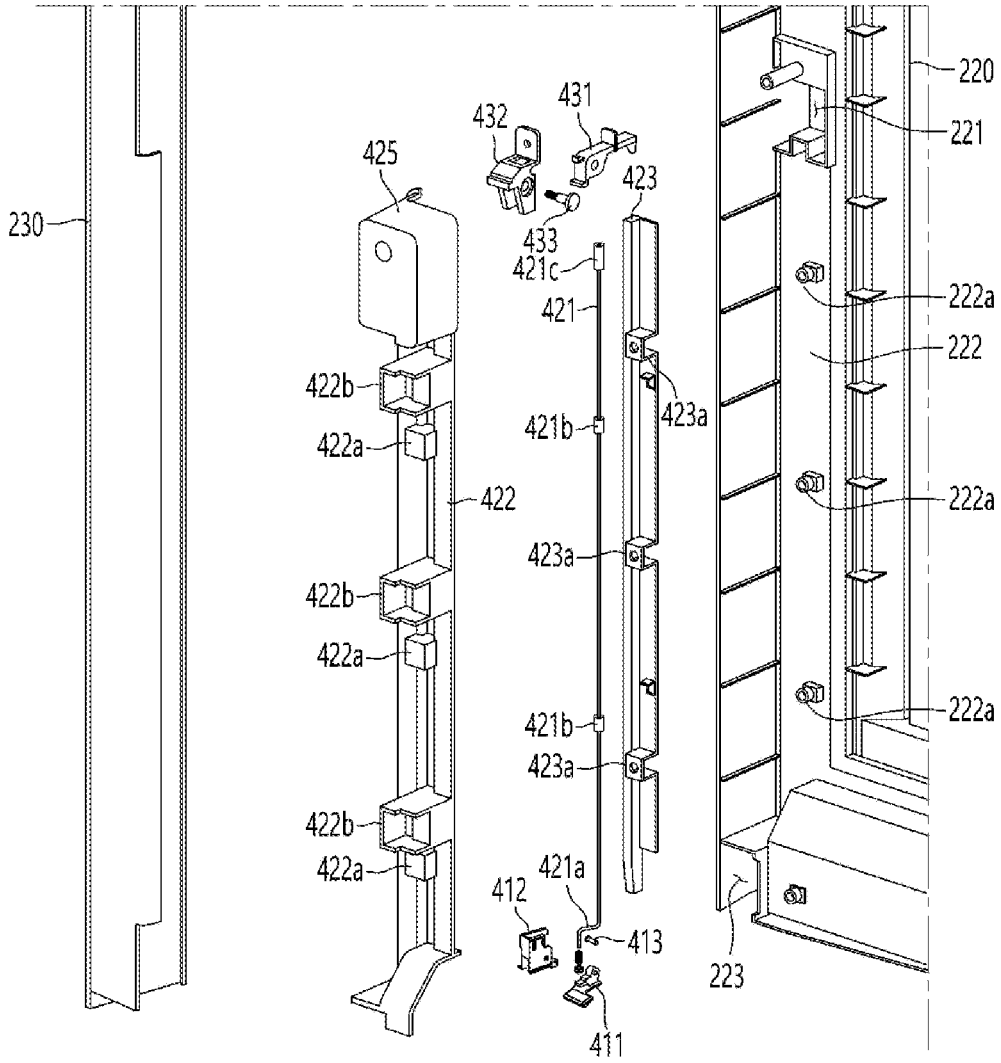
FIG. 7 is an enlarged view of portion A of FIG. 4.
Figure 8:
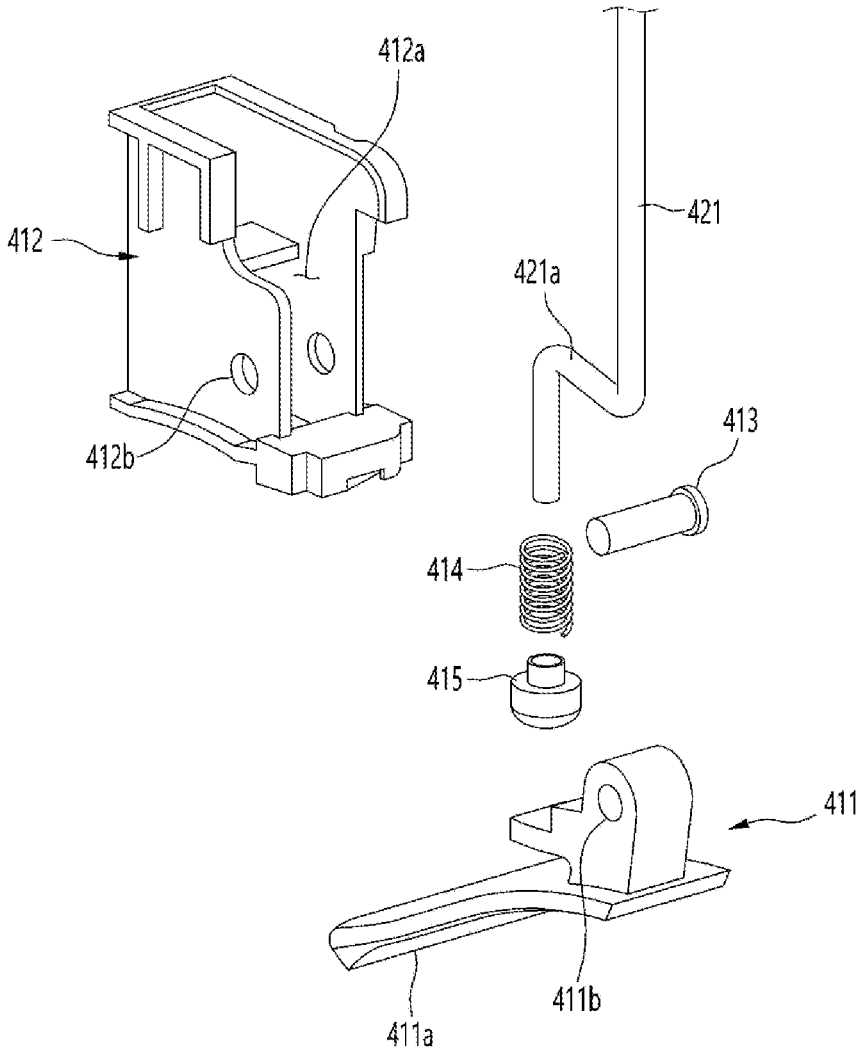
FIG. 8 is an exploded perspective view showing an example of an operation unit.
Figure 9:
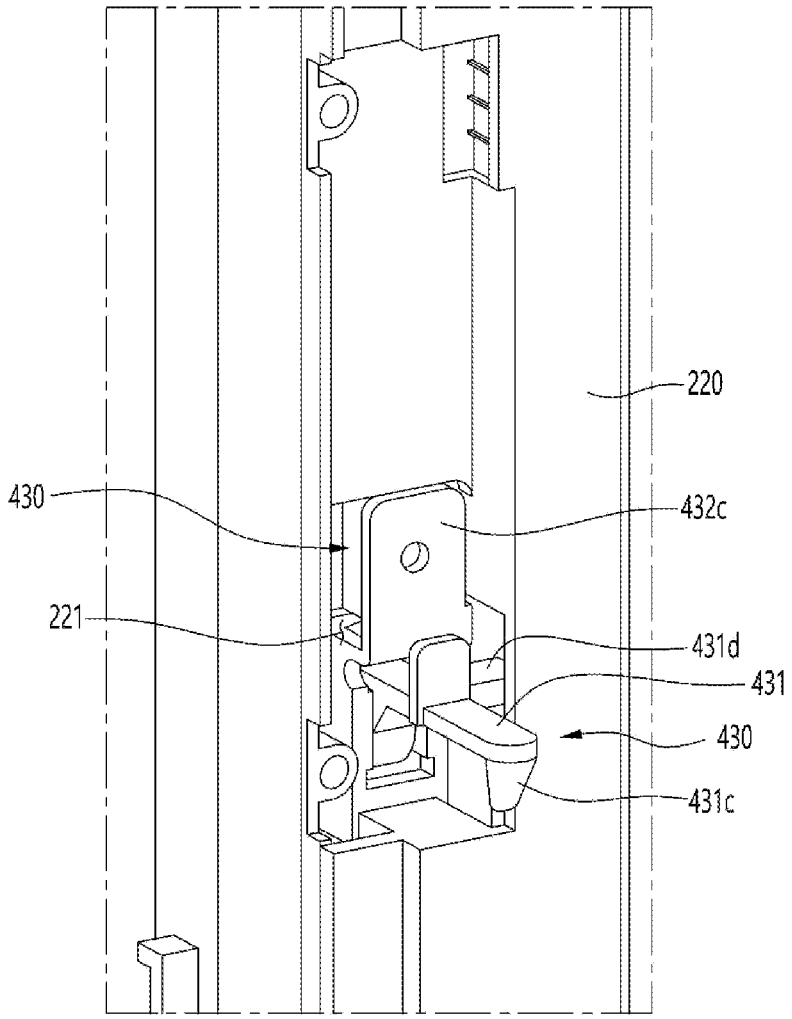
FIG. 9 is a diagram showing an example of a latch unit coupled to a sub-door.
Figure 10:
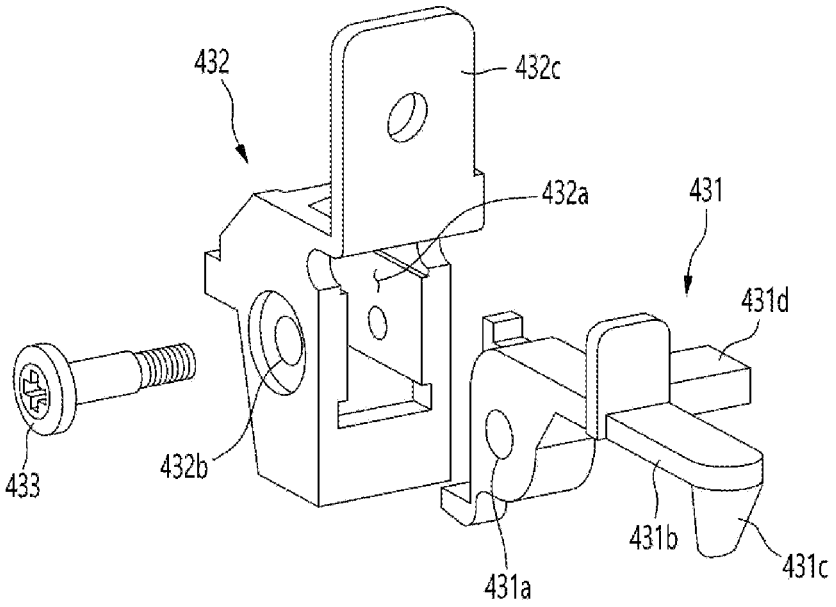
FIG. 10 is an exploded perspective view showing an example of a latch unit.
Figure 11:
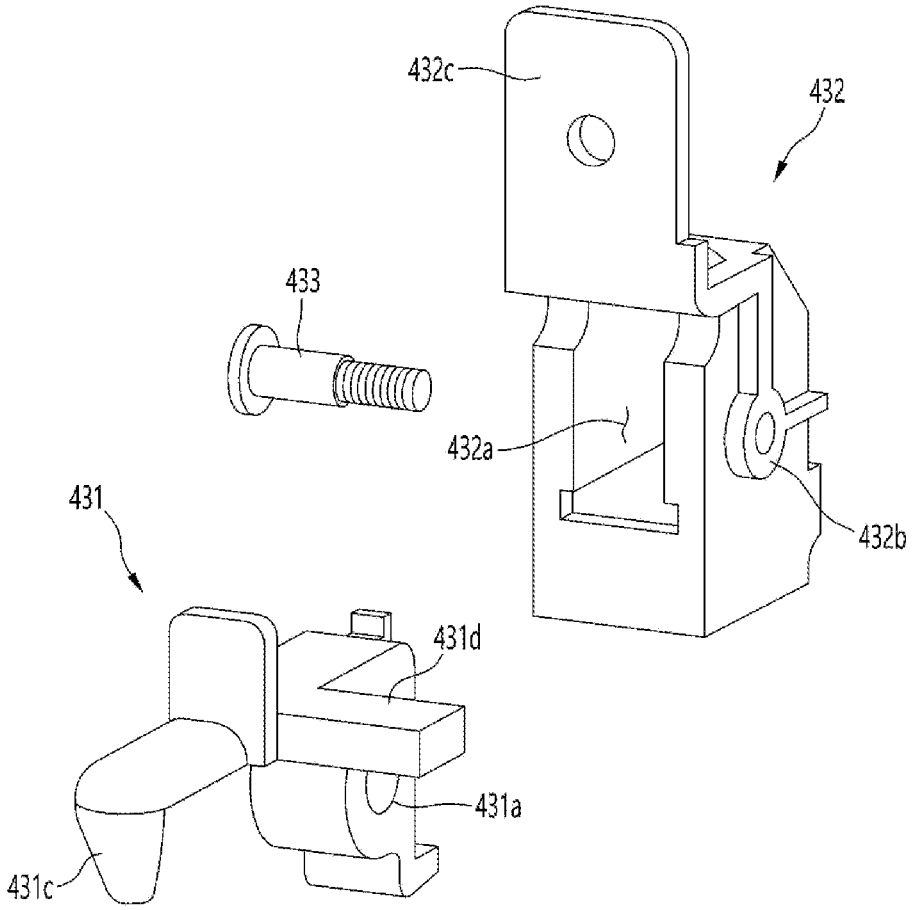
FIG. 11 is an exploded perspective view showing the latch unit in FIG. 10 viewed in another direction.
Figure 12:
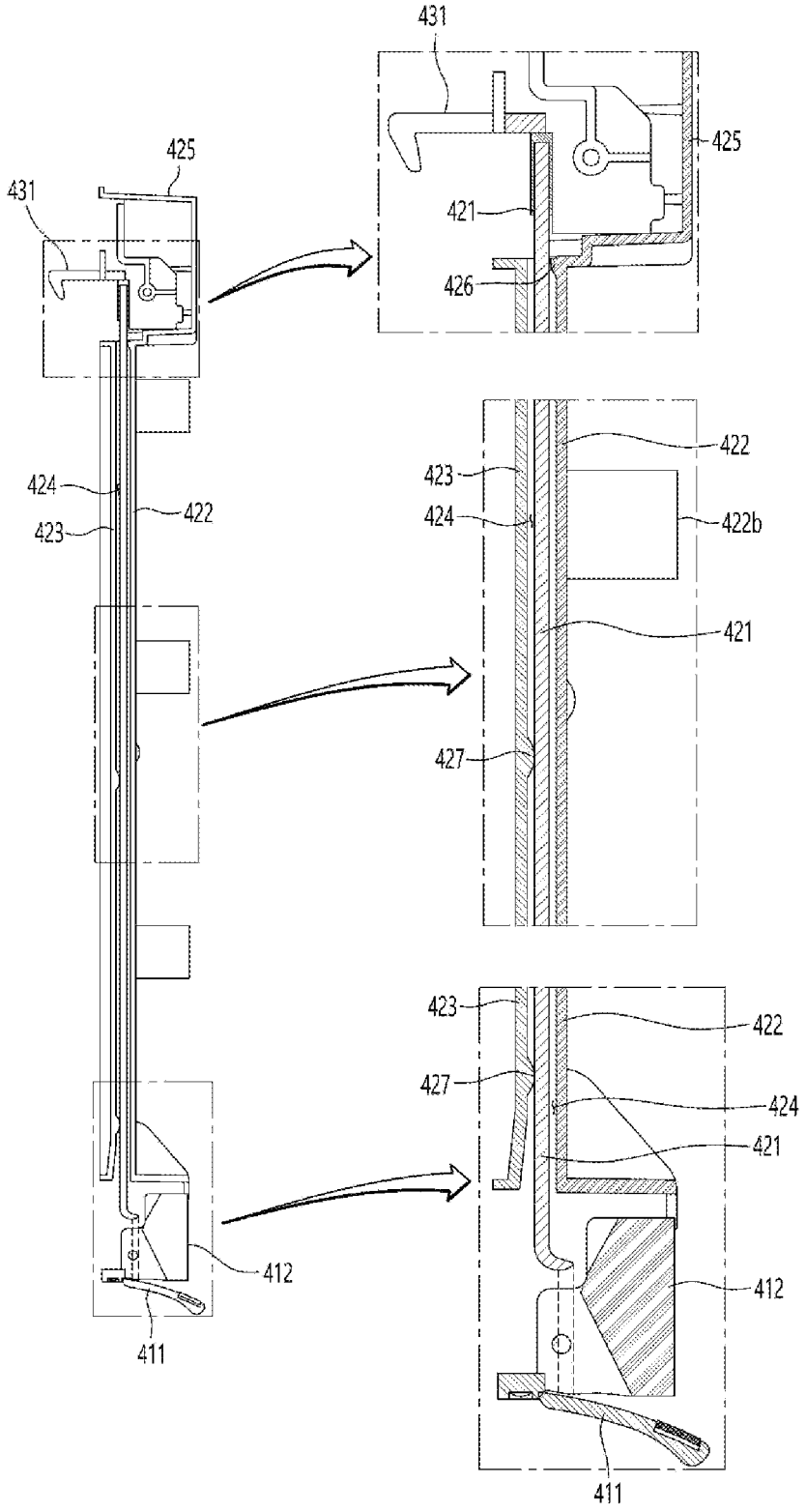
FIG. 12 is a cross-sectional view taken along line 12-12' of FIG. 6.

FIG. 4 is an exploded perspective view showing an example of a sub-door, FIG. 5 is a perspective view showing an example of a door opening/closing assembly, FIG. 6 is a perspective view of the door opening/closing assembly in FIG. 5 viewed in another direction, FIG. 7 is an enlarged view of portion A of FIG. 4, FIG. 8 is an exploded perspective view showing an example of an operation unit, FIG. 9 is a diagram showing an example of a latch unit coupled to a sub-door, FIG. 10 is an exploded perspective view showing an example of a latch unit, FIG. 11 is an exploded perspective view of the latch unit in FIG. 10 viewed in another direction, and FIG. 12 is a cross-sectional view taken along line 12-12' of FIG. 6.

Referring to FIGS. 4 to 12, the sub-door 200 is provided at the front side of the refrigerator 1, and can include an outer case 210 defining an outer surface, and a door liner defining a rear surface, and a cap deco 230 defining an upper surface, a lower surface, and side surfaces. In addition, the door opening/closing assembly 400 can be provided in the inner space of the sub-door 200 defined by the outer case 210, the door liner 220, and the cap deco 230.

In addition, the inner space of the sub-door 200 can be foam-filled with an insulating material for heat-insulation while the door opening/closing assembly 400 is mounted, and in this case, the door opening/closing assembly 400 is embedded by an insulating material and is configured such that internal components can operate without being affected by the insulating material.

The door opening/closing assembly 400 can include an operation unit 410 for a user to operate, a latch unit 430 for opening and closing the sub-door, and a connection unit 420 to allow the operation unit 410 and the latch unit 430 to be interlocked with each other.

In detail, the operation unit 410 can be provided at the lower side of the sub-door 200. The operation unit 410 is operated by a user for the operation of the latch unit 430 and can be provided at one side of the lower end of the sub-door 200. In this case, the operation unit 410 can be provided at a side far from the rotation axis of the sub-door 200 to facilitate the rotation operation of the sub-door 200.

The operation unit 410 is configured to protrude out of the sub-door 200 while being installed at the lower side of the sub-door 200 such that a user can operate the operation unit 410. The operation unit 410 can be installed on the lower side of the sub-door 200 and configured to be operated by the user's operation. In detail, the operation unit 410 can be installed at the lower side of the sub-door 200 and configured to be rotatable in the vertical direction. The operation unit 410 can be disposed at one side of the grip portion 33 and configured to expose only a part of a portion to be operated by the user such that the exposed portion when the user sees it from the front is to be minimized.

In some implementations, the operation unit 410 can be provided in the operation unit accommodating portion 223 formed in a lower portion of the door liner 220 of the sub-door 200. However, implementations of the present disclosure are not limited thereto. For example, the operation unit 410 can be mounted in the cap deco 230 defining the lower end of the sub-door 200.

In detail, the operation unit 410 can include an operation member 411 that a user can press and operate, and an operation member case 412 that is mounted in the sub-door 200 to define a space in which the operation member 411 is accommodated, and an operation member rotation shaft 413 connecting the operation member 411 and the operation member case 412 and defining a rotational center axis of the operation member 411.

The operation member 411 is mounted to be operable by a user's operation. For example, the operation member 411 is mounted to be movable up and down. In detail, the operation member 411 can include a pressing portion 411*a* and can be moved in a vertical direction during the user's operation. A connection member 421, which will be described later, is in contact with the upper portion of the operation member 411, and when the operation member 411 moves in the vertical direction, the connection member 421 is movable.

In more detail, the operation member 411 can be mounted so as to be rotatable in a vertical direction based on a rotational center axis. When the user operates the pressing portion 411*a* upward, the operation member 411 can rotate about a rotational center axis and move upward.

The pressing portion 411*a* can protrude downward from the sub-door 200 to be exposed to the outside. The pressing portion 411*a* can rotate in a direction closer to the sub-door 200 by the user's operation while being spaced apart from the sub-door 200.

In some implementations, when the operation member 411 rotates in the direction closer to the sub-door 200, the upper surface of the operation member 411 can contact the sub-door 200. The operation member 411 can further include a retracting portion 411*c* (see FIGS. 13A and 13B) provided on the upper surface to be retractable, thereby increasing a turning radius inside the sub-door 200 and enabling smooth rotation. More specifically, when the user presses the pressing portion 411*a* and the operation member 411 is rotated upward around a rotational center axis, the retracting portion 411*c* provided on the upper surface of the pressing portion 411*a* is introduced by the cap deco 230 of the sub-door 200, making smooth rotation possible.

The operation member case 412 can include an operation member accommodating portion 412*a* accommodating the operation member 411 therein. The operation member 411 can be mounted to the operation member accommodating portion 412*a* to be movable up and down. More specifically, the operation member 411 can be mounted to the operation member accommodating portion 412*a* so as to be rotatable vertically around the operation member rotation shaft 413.

In a state in which the operation member 411 is mounted to the operation member accommodating portion 412*a*, the pressing portion 411*a* protrudes to the outside of the operation member accommodating portion 412*a* to be exposed to the outside of the sub-door 200.

The operation member case 412 can be provided in the operation unit accommodating portion 223, but is not limited thereto.

The operation member rotation shaft 413 can define a rotational center axis of the operation member 411. Through the operation member rotation shaft 413, the operation member 411 can rotate in a vertical direction around the operation member rotation shaft 413. More specifically, when the user presses the pressing portion 411*a* upward, the operation member 411 can move by rotating upward based on the operation member rotation shaft 413.

In some implementations, the operation member rotation shaft 413 can connect the operation member 411 and the operation member case 412. As an example, the operation member 411 has an operation member through-hole 411*b* formed therein such that the operation member rotation shaft 413 is inserted into the operation member through-hole 411*b*, and the operation member case 412 has a case through-hole 412*b* formed therein such that the operation member rotation shaft 413 is inserted into the case through-hole 412*b*. In addition, the operation member rotation shaft 413 can be inserted into the operation member through-hole 411*b* and the case through-hole 412*b* to connect the operation member 411 and the operation member case 412. Accordingly, the operation member 411 can be rotatably coupled to the operation member case 412 through the operation member rotation shaft 413.

In some implementations, the operation unit 410 can further include an elastic member 414 and a support member 415. The connection member 421 can be more stably supported by the operation member 411 through the elastic member 414 and the support member 415. In some examples, the elastic member 414 can include one or more springs.

The elastic member 414 can be disposed between the operation member 411 and the connection member 421. Alternatively, the elastic member 414 can be coupled to a lower portion of the connection member 421. The elastic member 414 can provide an elastic force that causes the operation member 411 to return to its original position when the operation member 411 moves in the vertical direction. More specifically, the elastic member 414 is provided inside the operation member case 412, and in a state in which the operation member 411 is moved upward, the elastic member 414 can be compressed by the operation member case 412.

The support member 415 can be disposed between the operation member 411 and the connection member 421. The support member 415 can be formed such that a part of the connection member 421 can be drawn in and out of the support member 415. Accordingly, when the connection member 421 moves, a part of the connection member 421 can be drawn in and out of the support member 415 and supported.

The latch unit 430 can be provided above the operation unit 410. The latch unit 430 can be provided above the operation unit 410 to interlock with the operation unit 410.

The latch unit 430 can be mounted to the sub-door 200 such that the sub-door 200 can be opened and closed. Specifically, the latch unit 430 can be rotatably mounted inside the sub-door 200. In addition, a part of the latch unit 430 can pass through the door liner 220 and protrude rearward. In detail, the rear end of the latch unit 430 can pass through the door liner 220 and protrude rearward.

In addition, a latch accommodating portion 130 can be formed at a position of the main door 100 corresponding to the position of the latch unit 430 in the sub-door 200. Accordingly, the latch unit 430 protruding rearward can be selectively held and constrained in the latch accommodating portion 130. Accordingly, it is possible to selectively open and close the sub-door 200 by the operation of the latch unit 430.

More specifically, the latch unit 430 can include a latch member 431 that is rotatably formed to fix the sub-door 200, a latch bracket 432 that accommodates the latch member 431, and a latch member rotation shaft 433 that connects the latch member 431 and the latch bracket 432 to form a rotational center axis of the latch member 431.

The latch member 431 is mounted to be rotatable up and down. The latch member 431 interlocks with the operation unit 410 and can move vertically by rotating around the latch member rotation shaft 433. In more detail, the latch member 431 is disposed to come into contact with the connection member 421 contacting the operation member 411. Accordingly, when the user operates the pressing portion 411*a* of the operation member 411 and moves the operation member 411 vertically, so that the connection member 421 moves. In addition, the latch member 431 can be rotated vertically by interlocking with the operation member 411.

The latch member 431 rotates vertically by interlocking with the operation member 411 and can be selectively held and constrained by the latch accommodating portion 130. That is, the sub-door 200 can be opened or closed by the rotation of the latch member 431.

In more detail, the latch member 431 can include a latch body portion 431*b* and a constraining portion 431*c* formed at an end of the latch body portion 431*b*.

The latch body portion 431*b* can be provided rotatably around a rotational center axis. A part of the latch body portion 431*b* can pass through the outer surface of the sub-door 200. More specifically, the latch unit 430 can be configured such that a part of the latch body portion 431*b* is positioned inside the door liner 220, and the remaining part of the latch body portion 431*b* extends protrude rearward by passing through the door liner 220 in a state in which the latch unit 430 is mounted in the door liner 220.

In some implementations, the latch body portion 431*b* can be formed to extend in the front-rear direction. In addition, the latch body portion 431*c* can include an extension portion 431*d* protruding from one side of the latch body portion 431*b* in a left-right direction. A connection member 421 to be described later can be in contact with the lower surface of the extension portion 431*d*. In detail, an upper end of the connection member 421 can contact the extension portion 431*d*. Accordingly, when the user operates the operation member 411 upward, the connection member 421 whose lower end contacts the operation member 411 moves upward. In addition, the upper end of the connection member 421 is in contact with the latch extension portion 431*d*, and due to the upward movement of the connection member 421, the latch member 431 can move upward by rotating around the rotational center axis.

In some examples, the extension portion 431*d* can be inserted into a depression portion formed in the vicinity of a bracket coupling portion 221 of the door liner 220 which is to be described later. Accordingly, when the latch member 431 moves by rotating in the vertical direction, separation of the latch member 431 can be prevented.

The constraining portion 431*c* can be formed at an end of the latch body portion 431*b*. In detail, the constraining portion 431*c* can be formed to protrude downward from the rear end of the latch body portion 431*b*. For example, the constraining portion 431*c* can have a hook shape formed at the rear end of the latch body portion 431*b* to face downward. The latch member 431 can be selectively held and constrained by the latch accommodating portion 130 through the constraining portion 431*c*.

In some implementations, the constraining portion 431*c* can be selectively held and constrained by a holding portion 131 formed in the latch accommodating portion 130. In detail, the holding portion 131 having a protrusion shape protruding upward can be formed in the latch accommodating portion 130. Accordingly, when the latch member 431 is inserted into the latch accommodating portion 130 and moves downward by rotating, the constraining portion 431*c* can be selectively held and constrained by the holding portion 131.

In some implementations, the holding portion 131 can define an inclined surface to induce the constraint of the constraining portion 431*c*. The constraining portion 431*c* can be formed to protrude downward so as to be inclined in a shape corresponding to the inclined surface of the holding portion 131. Accordingly, when the constraining portion 431*c* moves along the inclined surface of the holding portion 131, the latch member 431 moves by rotating, so that the constraining portion 431*c* is held and constrained in the holding portion 131.

The latch bracket 432 can accommodate the latch member 431. The latch bracket 432 can include a bracket accommodating portion 432*a* that accommodates the operation member 411 therein. The latch member 431 can be rotatably mounted to the bracket accommodating portion 432*a*. In a state in which the latch member 431 is mounted to the bracket accommodating portion 432*a*, a part of the latch member 431 can protrude to the outside of the operation member accommodating portion 412*a* to be exposed to the outside of the sub-door 200. In detail, a part of the latch body portion 431*b* can protrude to the outside of the operation member accommodating portion 412*a* to be exposed to the outside of the sub-door 200.

In some implementations, the latch bracket 432 can be coupled to the door liner 220. For example, the door liner 220 can include a bracket coupling portion 221 to which the latch bracket 432 is coupled. In addition, the latch bracket 432 can further include a bracket fixing portion 432*c* coupled to the bracket coupling portion 221. When the latch bracket 432 is coupled to the bracket coupling portion 221, a part of the latch body portion 431*b* protrudes to the outside of the door liner 220 to be exposed to the outside of the sub-door 200.

The latch member rotation shaft 433 can form a rotational center axis of the latch member 431. Through the latch member rotation shaft 433, the latch member 431 can rotate vertically around the latch member rotation shaft 433. More specifically, when the user presses the pressing portion 411*a* upward, the operation member 411 can rotate and move upward based on the operation member rotation shaft 413. In addition, the latch member 431 that interlocks with the operation member 411 can move upward by rotating based on the latch member rotation shaft 433.

In some implementations, the latch member rotation shaft 433 can connect the latch member 431 and the latch bracket 432. For example, a latch member through-hole 431*a* is formed in the latch member 431 such that the latch member rotation shaft 433 is inserted into the latch member through-hole 431*a*, and a bracket through-hole 432*b* can be formed in the latch bracket 432 such that the latch member rotation shaft 433 is inserted into the bracket through-hole 432*b*. Further, the latch member rotation shaft 433 can be inserted into the latch member through-hole 431*a* and the bracket through-hole 432*b* to connect the latch member 431 and the latch bracket 432. Accordingly, the latch member 431 can be rotatably coupled to the latch bracket 432 through the latch member rotation shaft 433.

In some examples, the latch member 431 can be accommodated in the latch bracket 432, but the implementations of the present disclosure is not limited thereto. For example, in some examples, the latch bracket 432 may be omitted.

In some implementations, the connection unit 420 can be formed in the shape of a rod extending vertically to connect the operation unit 410 and the latch unit 430 such that the latch unit 430 is operated according to the operation of the operation unit 410. A lower end of the connection unit 420 can be configured to contact the operation unit 410, and an upper end thereof can be configured to contact the lower surface of the latch unit 430.

In detail, the connection unit 420 can include a connection member 421 that enables the operation unit 410 to interlock with the latch unit 430, and connection member cases 422 and 423 in which the connection member 421 is accommodated, and a latch case 425 in which the latch unit 430 is accommodated.

The connection member 421 is formed in a rod shape having a predetermined length, and is configured such that an upper end thereof is in contact with the lower surface of the latch member 431, and a lower end thereof is in contact with the upper surface of the operation member 411. In detail, the connection member 421 can contact the latch body portion 431*b*. In more detail, the connection member 421 can contact a portion of the latch body portion 431*b* positioned inside the door liner 220.

The connection member 421 can cause the operation member 411 to interlock with the latch member 431. Accordingly, when the user operates the operation member 411 to operate the operation member 411, the connection member 421 moves in the first direction to cause the latch member 431 to move by interlocking with the operation member 411.

In some implementations, when the user operates the operation member 411 so that the operation member 411 moves upward by rotating about a rotational center axis, the connection member 421 moves upward, and the latch member 431 can move upward by rotating about the rotational center axis. However, the implementation of the present disclosure is not limited thereto, and the connection member 421 can move in a left-right direction or a front-rear direction such that the latch member 431 operates along the operation member 411.

In some implementations, the connection unit 420 can further include elastic portions 421*b* and 421*c* coupled to the connection member 421. The elastic portions 421*b* and 421*c* can include a first elastic portion 421*b* and a second elastic portion 421*c*. In some examples, the elastic portions 421*b* and 421*c* can have cylindrical shapes and be made of rubber or a plastic material.

When the connection member 421 moves in the first direction, the first elastic portion 421*b* can prevent movement in another direction. As an example, when the connection member 421 moves in the vertical direction, the first elastic portion 421*b* can prevent movement in the left-right direction. More specifically, the first elastic portion 421*b* is coupled to the connection member 421 and can be provided to protrude outward from the connection member 421.

A plurality of first elastic portions 421*b* can be provided to be spaced apart from the connection member 421.

The outer diameter of the first elastic portion 421*b* can be formed smaller than the inner diameter of the connection member accommodating portion 424 to be described later. When the connection member 421 is moved while the connection member 421 is accommodated in the connection member accommodating portion 424, the first elastic portion 421*b* protruding from the connection member 421 can come into contact with the connection member accommodating portion 424 to prevent movement in other directions.

The second elastic portion 421*c* can be coupled to an upper end of the connection member 421. In detail, the second elastic portion 421*c* is provided at the upper end of the connection member 421 contacting the lower surface of the latch member 431, to allow the connection member 421 to smoothly rotate the latch member 431. In some examples, the connection member 421 can have generally a bar shape that extends in a vertical direction.

In some implementations, the connection member 421 defines a bent portion 421*a* such that the lower end of the connection member 421 can contact the operation member 411 located at the rear in the inside of the connection member cases 422 and 423, and can be configured to be stably moved when the operation member 411 moves in the vertical direction. That is, the connection member 421 can define the bent portion 421*a* such that the lower end of the connection member 421 is in contact with the operation member 411. For example, the bent portion 421*a* that is horizontally bent can be formed in a portion of the connection member 421 extending in the vertical direction. The connection member 421 is bent in the horizontal direction at the bent portion 421*a* and then extends downward so that the lower end can contact the operation member 411.

In some implementations, the connection member 421 are provided in a separate configuration from the operation member 411 or the latch member 431, but the implementation of the present disclosure is not limited thereto. For example, in some examples, the connection member 421 can be integrally formed with the operation member 411 or the latch member 431.

The connecting member cases 422 and 423 can be fixed to the door liner 220. In detail, the rear portions of the connection member cases 422 and 423 can be coupled to a case coupling portion 222 formed in the door liner 220.

In some implementations, a first coupling portion 222*a* can be formed in the case coupling portion 222 to be coupled to the connection member cases 422 and 423. In addition, second and third coupling portions 422*a* and 423*a* can be formed in the connection member cases 422 and 423 corresponding to the position of the first coupling portion 222*a*. The connection member cases 422 and 423 can be coupled to the case coupling portion 222 by coupling between the first coupling portion 222*a* and the second and third coupling portions 422*a* and 423*a*. The first to third coupling portions 222*a*, 422*a*, and 423*a* can be provided in plural, and for example, can be coupled by a fastening member.

Upper ends of the connection member cases 422 and 423 can be connected to a latch case 425 to be described later. In detail, the upper end of the connection member cases 422 and 423 can be connected to the latch case 425 such that the upper end of the connection member 421 accommodated inside the connection member cases 422 and 423 contacts the latch member 431.

Further, the lower ends of the connection member cases 422 and 423 can be coupled to the operation member case 412. In detail, the lower ends of the connection member cases 422 and 423 can be coupled to the operation member case 412 such that the lower end of the connection member 421 accommodated inside the connection member cases 422 and 423 contacts the operation member 411.

The connection member cases 422 and 423 can include a rib 422*b* supporting the cap deco 230 in the front of the connection member cases 422 and 423. A plurality of ribs 422*b* can be formed in the front of the connection member cases 422 and 423 to be spaced apart from each other. For example, the rib 422*b* can be formed to be stepped to correspond to the shape of the cap deco 230.

In some examples, the connection member cases 422 and 423 can have a connection member accommodating portion 424 in which the connection member 421 is accommodated. Accordingly, when the connection member cases 422 and 423 are mounted to the door liner 220, the connection member 421 can be accommodated in the connection member accommodating portion 424 so as to be movable vertically. In addition, when a heat insulating material is injected into the inside of the sub-door 200, the heat insulating material can be prevented from being introduced into the connection member cases 422 and 423.

In some implementations, the diameter of the connection member accommodating portion 424 is formed larger than the outer diameter of the connection member 421 such that the connection member 421 can be easily movable inside the connection member accommodating portion 424.

Protrusions 426 and 427 can be formed in the inner surfaces of the connection member cases 422 and 423 to prevent movement in a second direction crossing the first direction when the connection member 421 moves in the first direction.

In some implementations, the connection member 421 can be formed to move in a vertical direction, and the protrusions 426 and 427 can be formed to prevent the connection member 421 from moving in a left-right direction.

The protrusions 426 and 427 can be provided in plural to prevent the connection member 421 from moving in the left-right direction. The protrusions 426 and 427 can include a first protrusion 426 formed in a first connection member case 422 to be described later and a second protrusion 427 formed in a second connection member case 423 to be described later.

Specifically, the protrusions 426 and 427 can be provided on the inner surfaces of the connection member cases 422 and 423. The protrusions 426 and 427 can be formed on the inner surfaces of the connection member cases 422 and 423 to protrude toward the inner space of the connection member accommodating portion 424. It can be seen that the protrusions 426 and 427 protrude toward the connection member 421 in a state in which the connection member 421 is accommodated in the connection member accommodating portion 424.

In addition, the protrusions 426 and 427 can be provided to be in contact with the connection member 421. Accordingly, when the connection member 421 moves in the first direction, the protrusions 426 and 427 can prevent the connection member 421 from moving in the second direction. As an example, when the connection member 421 is moved in a vertical direction, the protrusions 426 and 427 can press the connection member 421 on the front and rear sides, so that the shaking of the connection member 421 can be reduced.

The protrusions 426 and 427 can be provided to be elastically deformable.

The connection member cases 422 and 423 can include a first connection member case 422 and a second connection member case 423. In this case, the connection member accommodating portion 424 can be formed by coupling between the first connection member case 422 and the second connection member case 423.

The first connection member case 422 can be provided at the front side of the connection member cases 422 and 423. A rib 422*b* is formed in the first connection member case 422 provided at the front side to support the cap deco 230.

The rear surface of the first connection member case 422 can define the connection member accommodating portion 424 in a state in which the first connection member case 422 is coupled to the second connection member case 423. That is, a part of the rear surface of the first connection member case 422 can define the connection member accommodating portion 424 that is the inner space of the connection member cases 422 and 423 in a state in which the first connection member case 422 is coupled to the second connection member case 423.

In some implementations, the second coupling portion 422*a* can be formed in the first connection member case 422. The second coupling portion 422*a* can be coupled to the first and third coupling portions 222*a* and 423*a* so that the connection member cases 422 and 423 can be coupled to the case coupling portion 222.

In some examples, the first protrusion 426 can be formed on the first connection member case 422. In more detail, the first protrusion 426 can be formed on the rear surface of the first connection member case 422 constituting the connection member accommodating portion 424. The first protrusion 426 can be formed on the rear surface of the first connection member case 422 and protrude toward an inner space of the connection member accommodating portion 424.

A plurality of first protrusions 426 can be provided. In some implementations, the first protrusion 426 can be provided on the first connection member case 422. Accordingly, since the connection member 421 can be stably supported on the upper portions of the connection member cases 422 and 423, thus preventing movement in the left-right direction.

The second connection member case 423 can be provided at the rear side of the connection member cases 422 and 423. The second connection member case 423 provided at the rear side can be coupled to the door liner 220. In detail, the rear surface of the second connection member case 423 can be coupled to the case coupling portion 222 of the door liner 220.

The front surface of the second connection member case 423 can define the connection member accommodating portion 424 in a state in which the first connection member case 422 is coupled to the second connection member case 423. That is, a part of the front surface of the second connection member case 423 can define the connection member accommodating portion 424 that is the inner space of the connection member cases 422 and 423 in a state in which the first connection member case 422 is coupled to the second connection member case 423.

In some implementations, a third coupling portion 423*a* can be formed in the second connection member case 423. The third coupling portion 423*a* can be coupled to the first and second coupling portions 222*a* and 422*a*, so that the connection member cases 422 and 423 can be coupled to the case coupling portion 222.

In addition, the second protrusion 427 can be formed on the second connection member case 423. For example, the second protrusion 426 can be formed on the front surface of the first connection member case 422 constituting the connection member accommodating portion 424. The second protrusion 427 can be formed on the front surface of the second connection member case 423 and protrude toward an inner space of the connection member accommodating portion 424.

A plurality of second protrusions 427 can be provided. In some implementations, the second protrusion 427 can be provided at the middle or lower portion of the second connecting member case 423. Accordingly, since the connection member 421 can be stably supported in the middle or lower portions of the connection member cases 422 and 423, thus restricting movement in the left-right direction.

The latch case 425 can accommodate the latch bracket 432. In addition, the latch case 425 can be coupled to upper ends of the connection member cases 422 and 423. In detail, the latch case 425 can be opened such that an upper end of the connection member 421 accommodated inside the connection member cases 422 and 423 is in contact with the latch member 431. In addition, when a heat insulating material is injected into the sub-door 200, the heat insulating material can be blocked by the connection member cases 422 and 423 and may not be introduced into the inside through the latch case 425.

The latch case 425 can be integrally formed with the connection member cases 422 and 423. For example, the latch case 425 can be integrally formed with the first connection member case 422. However, the implementation of the present disclosure is not limited thereto. For example, the latch case 425 can be formed separately from the first and second connection member cases 422 and 423 and coupled to the first and second connection member cases 422 and 423. As another example, the latch case 425 can be omitted, and the latch bracket 432 can be directly coupled to the connection member cases 422 and 423.

Hereinafter, the operation of the door opening/closing assembly will be described in more detail through the drawings.

Figure 13A:
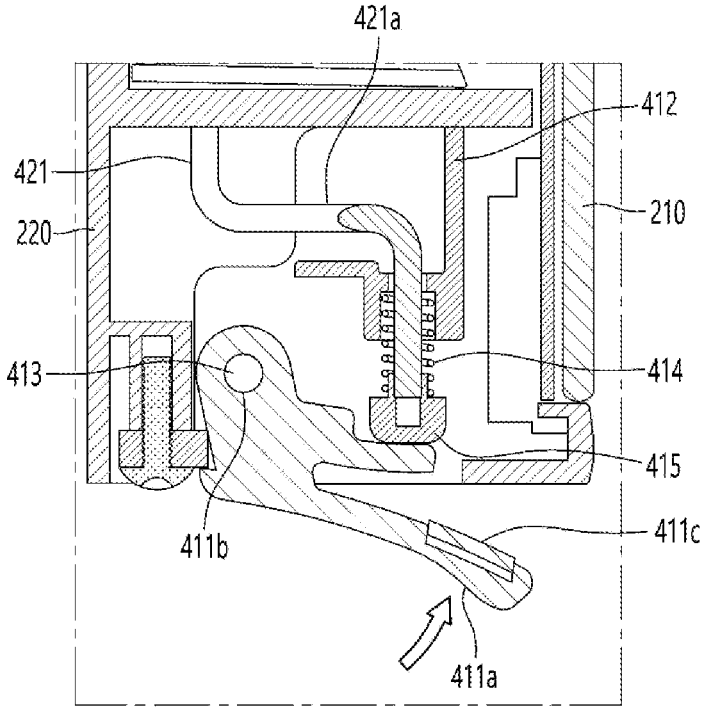
FIGS. 13A and 13B are cross-sectional views showing an example of an operation member and operation of a door opening/closing assembly.
Figure 13B:
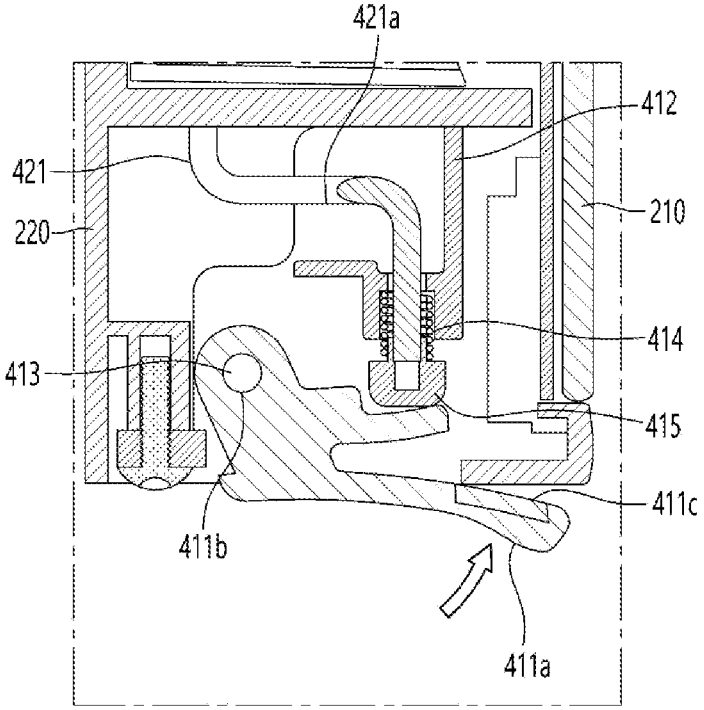
Figure 14A:
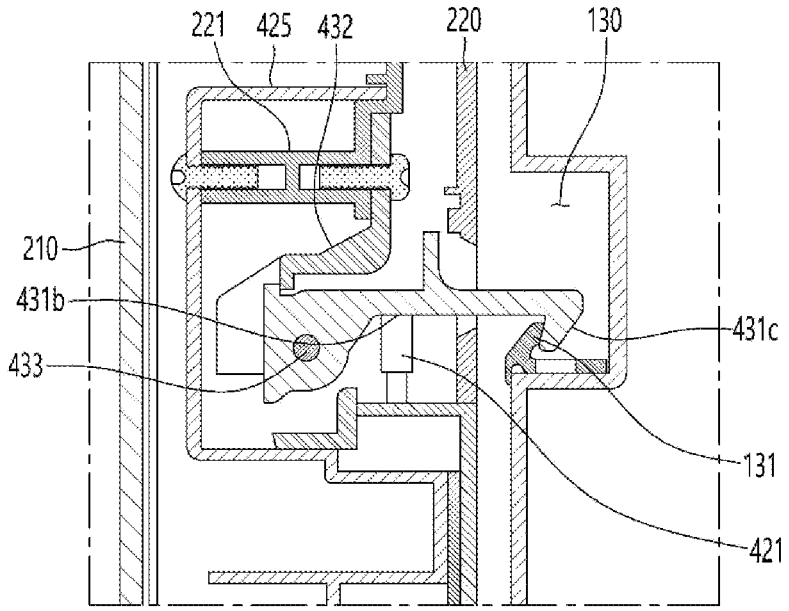
FIGS. 14A and 14B are cross-sectional views showing an example of a latch member and operation of a door opening/closing assembly.
Figure 14B:
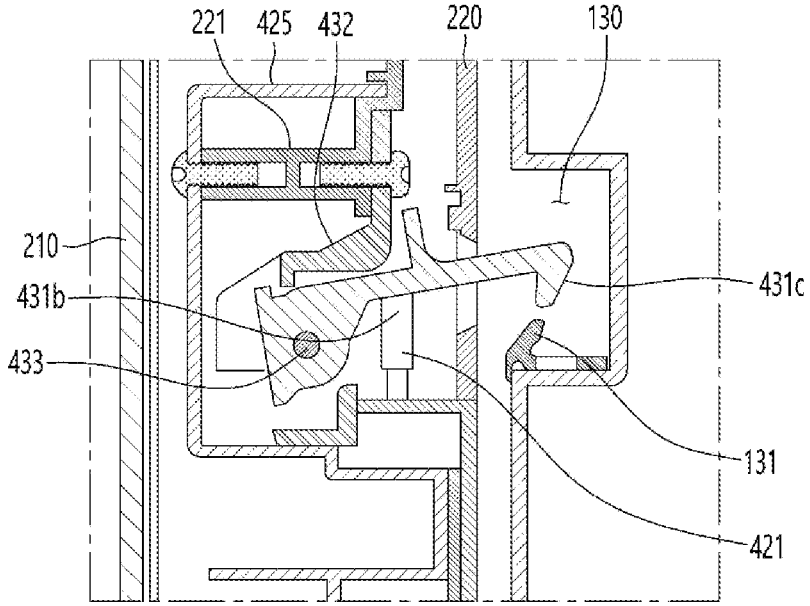
Figure 15A:
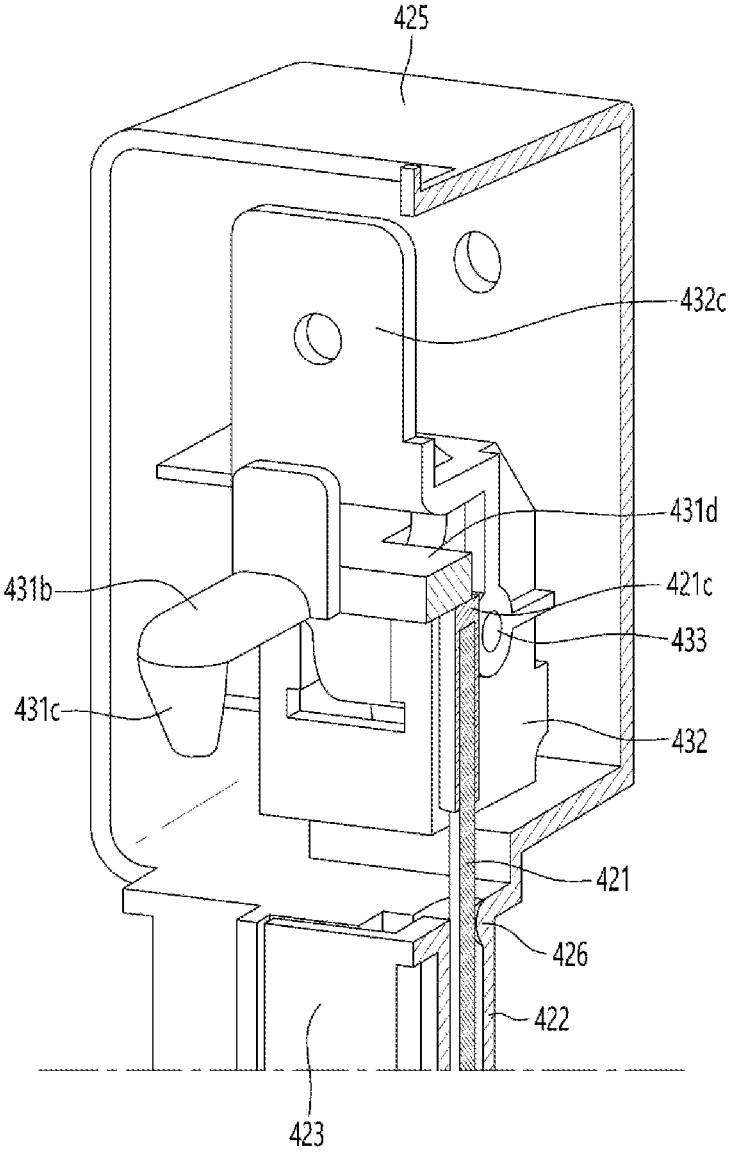
FIGS. 15A and 15B are cross-sectional views showing an example of a latch member and operation of a door opening/closing assembly.
Figure 15B:
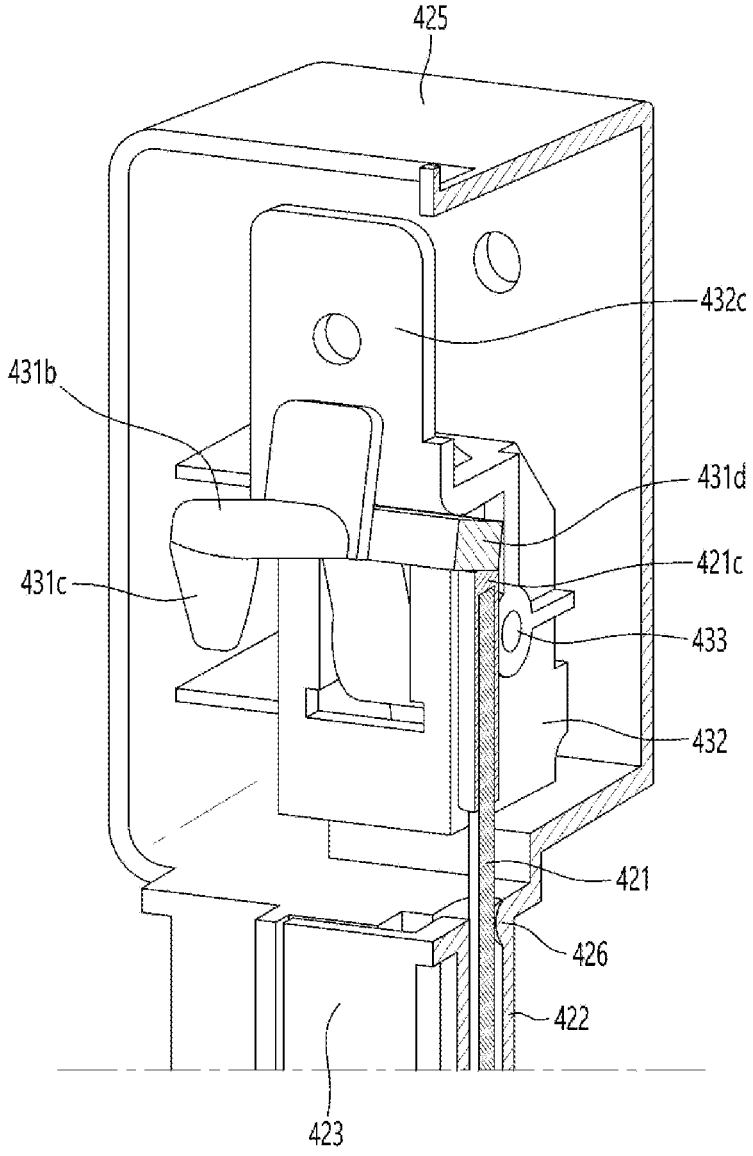

FIGS. 13A and 13B are cross-sectional views showing an example of an operation member and example operations of a door opening/closing assembly, FIGS. 14A and 14B are cross-sectional views showing an example of a latch member and example operations of a door opening/closing assembly, and FIGS. 15A and 15B are cross-sectional views showing an example of a latch member and example operations of a door opening/closing assembly.

Referring to FIGS. 13A to 15B, when the sub-door 200 is completely closed, the constraining portion 431*c* of the latch member 431 is held and constrained by the holding portion 131 of the latch accommodating portion 130.

In such a state, when the user wants to open the sub-door 200 and presses the pressing portion 411*a* of the operation member 411 upward, the operation member 411 can move upward by rotating around the operation member rotation shaft 413. In some examples, the operation member 411 can include a lever configured to rotate about an axis or rotation shaft 413 extending in a horizontal direction through a through-hole 411*b*.

The operation member 411 is configured to come into contact with the lower end of the connection member 421, and the connection member 421 can move upward due to the upward rotational movement of the operation member 411.

In this case, the elastic member 414 and the support member 415 can be provided between the connection member 421 and the operation member 411. When the operation member 411 is moved upward, the elastic member 414 is in a compressed state. In addition, a part of the connection member 421 can be inserted into the support member 415 and be stably supported.

In some implementations, the connection member 421 moves upward while being accommodated in the connection member accommodating portion 424 of the connection member cases 422 and 423. In this case, the connection member 421 can be prevented from moving in the left-right direction by the first and second protrusions 426 and 427 formed in the connection member cases 422 and 423. In addition, the elastic portion 421*b* coupled to the connection member 421 can prevent the connection member 421 from moving in the left-right direction. That is, the connection member 421 can stably move upward through the first and second protrusions 426 and 427 and the elastic portion 421*b*.

Further, since the upper end of the connection member 421 is in contact with the latch member 431, the latch member 431 moves upward by rotating around the latch member rotation shaft 433 when the connection member 421 moves upward. That is, the operation member 411 and the latch member 431 can interlock with each other through the connection member 421, so that latch member 431 moves upward.

When the latch member 431 moves upward by rotating around the latch member rotation shaft 433, constraint by the holding portion 131 of the constraining portion 431*c* formed at the rear end of the latch member 431 to face downward is released. Accordingly, the sub-door 200 can be opened.

In addition, when a hand pressing the pressing portion 411*a* is removed after the sub-door 200 is opened, the operation member 411 returns to its original position located on the lower side due to the elastic restoring force of the elastic member 414. Accordingly, the connection member 421 is also moved downward, and the latch member 431 connected to the connection member 421 also moves downward to return to the initial state.

In some examples, when the sub-door 200 is closed in a state in which the latch member 431 returns to the initial state, the constraining portion 431*c* of the latch member 431 moves along the inclined surface of the holding portion 131 and the latch member 431 rotates naturally, and the constraining portion 431*c* can be held and constrained by the holding portion 131.

In some implementations, the door opening/closing assembly is provided such that a latch member is provided at a position where the door is easily fixed, and the operation member is provided in an end of in the front portion which may not deteriorate the design of the front portion at a position where it is easy to operate, thus making it possible to maintain the opening and closing performance of the door while maintaining a more beautiful appearance.

In addition, there is an advantage in that the operation member is positioned on the side opposite to the rotational axis of the door so that the opening and closing of the door and the rotation operation can be performed at the same position, thereby making it easier to open and close the door.

In addition, the operation member is disposed on the side of the handle to make the user's operation convenient, and at the same time, the configuration for operation which is exposed to the front of the door is eliminated, thus providing a more beautiful appearance.

In addition, there is an advantage in that a protrusion is provided in a connection member case in which the connection member is accommodated to prevent the connection member from moving in other directions when the connection member is moved.

What is claimed is:

1. A refrigerator comprising:

a cabinet that defines a storage space;

a main door configured to, based on rotating in rotation directions relative to the cabinet, open and close the storage space, the main door defining an opening; and a sub-door configured to, based on rotating in the rotation directions of the main door relative to the main door, open and close the opening of the main door, the sub-door comprising an outer case that defines a front surface of the sub-door, and a door liner that defines a rear surface of the sub-door, wherein the sub-door further comprises:

an operation unit disposed at a lower side of the sub-door and configured to be operated by a user, a latch unit that is disposed vertically above the operation unit, that is spaced apart from the operation unit, and that protrudes from the rear surface of the sub-door toward the main door, the latch unit being configured to selectively couple the sub-door to the main door, and a connection unit that connects between the operation unit and the latch unit, the connection unit being configured to operate the latch unit based on the user operating the operation unit, wherein the main door comprises a latch accommodating portion that faces the latch unit and is configured to be caught by the latch unit, wherein the connection unit comprises:

a connection member that extends from an upper end in contact with the latch unit to a lower end in contact with the operation unit, the connection member being configured to move in a first direction to thereby operate the latch unit based on the user operating the operation unit, and a connection member case having an upper side connected to the latch unit and a lower side connected to the operation unit, the connection member case defining a connection member accommodating portion that receives the connection member, wherein the connection member case comprises a protrusion that protrudes from an inner surface of the connection member case toward the connection member, the protrusion being configured to, based on the connection member moving in the first direction, restrict movement of the connection member in a second direction crossing the first direction, wherein the sub-door further comprises a cap decor that is coupled to the outer case and the door liner, wherein the cap decor, the outer case, and the door liner define an inner space of the sub-door, the inner space accommodating an insulating material, wherein the connection member case is mounted in the inner space of the sub-door and blocks the insulating material from the connection member accommodating portion, wherein the connection member case comprises:

a first connection member case disposed at a front side of the connection member case; and a second connection member case disposed at a rear side of the connection member case and mounted to the door liner, wherein the first and second connection member cases are coupled to each other and define the connection member accommodating portion, wherein the protrusion comprises:

a first protrusion that protrudes from a rear surface of the first connection member case toward the second connection member case, and a second protrusion that protrudes from a front surface of the second connection member case toward the first connection member case, and wherein the first connection member case comprises a rib that is disposed at a front surface of the first connection member case and supports the cap decor.

2. The refrigerator of claim 1, wherein the protrusion is configured to contact the connection member.

3. The refrigerator of claim 1, wherein the connection unit further comprises an elastic portion that is coupled to the connection member and protrudes outward relative to the connection member, the elastic portion being configured to restrict movement of the connection member in the second direction, and wherein an outer diameter of the elastic portion is less than an inner diameter of the connection member accommodating portion.

4. The refrigerator of claim 3, wherein the elastic portion has a cylindrical shape and surrounds the connection member.

5. The refrigerator of claim 1, wherein the latch unit further comprises:

a latch member that is disposed at the door liner and protrudes toward the main door, the latch member passing through a rear surface of the door liner; and a latch case that accommodates the latch member and blocks the insulating material from the latch accommodating portion.

6. The refrigerator of claim 5, wherein the latch case is a part of the first connection member case.

7. The refrigerator of claim 5, wherein the latch accommodating portion is recessed from a front surface of the main door, and wherein the main door further comprises a holding portion that protrudes from the latch accommodating portion, the holding portion being configured to catch an end of the latch member.

8. The refrigerator of claim 7, wherein the latch member comprises a constraining portion that protrudes from an end of the latch member, the constraining portion having a hook shape and being configured to be caught by the holding portion.

9. The refrigerator of claim 8, wherein the constraining portion protrudes downward from the end of the latch member and is configured to be released from the holding portion based on the latch member rotating upward relative to the holding portion.

10. The refrigerator of claim 1, wherein the operation unit comprises an operation member disposed at the lower side of the sub-door and configured to move in a vertical direction.

11. The refrigerator of claim 10, wherein the sub-door is configured to rotate about a rotation axis extending parallel to the vertical direction.

12. The refrigerator of claim 11, wherein the operation member comprises a lever configured to rotate about an axis extending in a horizontal direction.

13. The refrigerator of claim 10, wherein the connection member comprises a bent portion having a lower end in contact with the operation member.

14. The refrigerator of claim 10, further comprising:

an elastic member coupled to the lower end of the connection member and configured to apply force to the operation member.

15. The refrigerator of claim 14, wherein the elastic member comprises a spring.

16. The refrigerator of claim 10, further comprising:

a support member disposed between the connection member and the operation member, the support member being configured to receive a part of the connection member.

17. The refrigerator of claim 16, wherein the lower end of the connection member is configured to insert into and withdraw from the support member based on movement of the connection member.

* * * * *